US009010926B2

(12) United States Patent
Moriya et al.

(10) Patent No.: US 9,010,926 B2
(45) Date of Patent: Apr. 21, 2015

(54) RECORDING APPARATUS

(71) Applicant: Seiko Epson Corporation, Tokyo (JP)

(72) Inventors: Yuki Moriya, Shiojiri (JP); Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 13/966,604

(22) Filed: Aug. 14, 2013

(65) Prior Publication Data

US 2014/0049589 A1 Feb. 20, 2014

(30) Foreign Application Priority Data

Aug. 18, 2012 (JP) ..... 2012-181249

(51) Int. Cl.

| | |
|---|---|
| ***B41J 2/01*** | (2006.01) |
| ***B41J 11/00*** | (2006.01) |
| ***B41J 3/407*** | (2006.01) |
| ***B41J 11/06*** | (2006.01) |

(52) U.S. Cl.

CPC ..... *B41J 11/00* (2013.01); *B41J 3/4078* (2013.01); *B41J 11/06* (2013.01)

(58) Field of Classification Search

USPC ..... 347/104, 101, 16

See application file for complete search history.

(56) References Cited

U.S. PATENT DOCUMENTS

| | | | |
|---|---|---|---|
| 2008/0238978 | A1 | 10/2008 | Niimi |
| 2010/0051682 | A1 | 3/2010 | Ichikawa et al. |

FOREIGN PATENT DOCUMENTS

| | | |
|---|---|---|
| JP | 11-334871 | 12/1999 |
| JP | 2008-238781 | 10/2008 |
| JP | 2010-061434 | 3/2010 |

*Primary Examiner* — Henok Legesse
(74) *Attorney, Agent, or Firm* — Workman Nydegger

(57) ABSTRACT

A recording apparatus includes a recording unit which performs recording on a recording medium; and a movable body which includes a support portion that supports the recording medium and which moves along a guide shaft, in which the movable body includes a bearing which is supported by the guide shaft and is movable in an opposite direction from gravity in relation to the guide shaft, and a load center which receives the moving force for the movement and is positioned on a straight line along a movement direction, where the straight line intersects a straight line in a gravity direction which passes through a center of gravity of the movable body.

7 Claims, 6 Drawing Sheets

RECORDING APPARATUS

BACKGROUND

1. Technical Field

The present invention relates to a recording apparatus which performs recording on a recording medium.

2. Related Art

Recording apparatuses which perform recording on a recording medium have been used in the related art. Of the apparatuses, there is disclosed a recording apparatus provided with a movable body, which includes a support portion which supports a recording medium, and a guide shaft which guides the movement of the movable body. For example, in JP-A-11-334871, JP-A-2008-238781, and JP-A-2010-61434 recording apparatuses are disclosed which include a movable body joined to a belt and which are configured to move the movable body by moving the belt with the power of a motor.

In the recording apparatus of the related art, there is a case in which a problem occurs due to the movable body vibrating when being moved. For example, there is a case in which shifting occurs in the recording position due to the vibration of the movable body during recording, such that the desired recorded image may not be obtained.

In JP-A-11-334871, the recording apparatus can move the movable body in accordance with the period of the vibration of the movable body. However, in such a configuration, there is a case in which the recording speed decreases. The recording apparatuses of JP-A-2008-238781 and JP-A-2010-61434, from the drawings and the like thereof, are of a shape in which a bearing provided on the movable body holds a guide shaft.

In such a configuration in which the bearing is supported so as to be constrained in relation to the guide shaft in all directions of the guide shaft, when the precision of the linearity of the guide shaft decreases, there is a case in which the frictional force which works on the contact surface between the bearing and the guide shaft increases and the movable body may no longer be moved. In addition, there is a case in which the manufacturing costs increase due to an improvement in the precision of the linearity of the guide shaft.

In addition, in the recording apparatus provided with a movable body for transporting the recording medium, a turning force acts on the movable body depending on the position of the load center which receives the moving force from the belt in the movable body. Accordingly, the degree of vibration of the movable body varies greatly depending on the position of the load center. However, the position of the load center in the movable body is not clearly disclosed in JP-A-11-334871, JP-A-2008-238781 and JP-A-2010-61434. Accordingly, in these recording apparatuses, there is a case in which the vibration which occurs when moving the movable body may not be suppressed.

SUMMARY

An advantage of some aspects of the invention is to suppress the vibration which occurs when moving the movable body for transporting the recording medium.

A recording apparatus of a first aspect of the invention includes a recording unit which performs recording on a recording medium; and a movable body which includes a support portion that supports the recording medium and which moves along a guide shaft, in which the movable body includes a bearing which is supported by the guide shaft and is movable in an opposite direction from gravity in relation to the guide shaft, and a load center which receives the moving force for the movement and is positioned on a straight line along a movement direction, where the straight line intersects a straight line in a gravity direction which passes through a center of gravity of the movable body.

Here, "moves along a guide shaft" means that the movable body moves in a state in which the weight of the movable body acts on the lower side of the guide shaft, and includes a case in which the guide shaft is inclined in relation to a horizontal surface. In addition, the term "center of gravity" is not limited to a strict definition of the position of the center of gravity, but includes a position in the proximity of the center of gravity. In addition, the term "gravity direction" is not limited to a strict definition of the gravity direction, but means a direction which contains at least the vector component of the gravity direction. Furthermore, the term "opposite direction from gravity" is not limited to a strict definition of the direction opposite from the gravity direction, but means a direction which contains at least the vector component of the opposite direction from gravity.

In this case, the load center is positioned on a straight line along a movement direction, where the straight line intersects a straight line in a gravity direction which passes through a center of gravity of the movable body. Accordingly, when the movable body moves, since the movable body moves in a state in which turning force (a turning force with the gravity direction as the axis of rotation) does not act thereon in the horizontal direction, the vibration in the horizontal direction is reduced.

In addition, the bearing is supported by the guide shaft so as to be movable in the opposite direction from gravity in relation to the guide shaft. Accordingly, occurrences of a situation in which the movable body may not be movable are reduced even in a case in which the precision of the linearity of the guide shaft is reduced a little.

A recording apparatus according to a second aspect of the invention includes a recording unit which performs recording on a recording medium; and a movable body which includes a support portion that supports the recording medium and which moves along a guide shaft, in which the movable body includes a bearing which is supported by the guide shaft and is movable in an opposite direction from gravity in relation to the guide shaft, and a load center which receives the moving force for the movement and is positioned on a straight line along a movement direction, where the straight line intersects a straight line in a gravity direction which passes through a center portion of the support portion in a direction which intersects both the movement direction of the movable body and the gravity direction.

In the recording apparatus including the movable body for transporting a general recording medium, the support portion which supports the recording medium is substantially bilaterally symmetrical in the movement direction of the movable body. Accordingly, in such a recording apparatus, "on a straight line along a movement direction, where the straight line intersects a straight line in the gravity direction which passes through a center portion of the support portion" and "on a straight line along a movement direction, where the straight line intersects a straight line in a gravity direction which passes through a center of gravity of the movable body" are the same in many cases. Furthermore, the term "center portion" is not limited to a strict definition of the center, but includes a position in the proximity of the center.

In other words, in this case, in the same manner as in the first aspect, when the movable body moves, the movable body may move in a state in which a turning force (a turning force with the gravity direction as the axis of rotation) does not act thereon in the horizontal direction, and the vibration in the horizontal direction may be reduced.

In addition, the bearing is supported by the guide shaft so as to be movable in the opposite direction from gravity in relation to the guide shaft. Accordingly, occurrences of a situation in which the movable body may not be movable are reduced even in a case in which the precision of the linearity of the guide shaft is reduced a little.

A recording apparatus of a third aspect of the invention includes a recording unit which performs recording on a recording medium; and a movable body which includes a support portion that supports the recording medium and which moves along a guide shaft, in which the movable body includes a bearing which is supported by the guide shaft and is movable in an opposite direction from gravity in relation to the guide shaft, and a load center which receives the moving force for the movement and is positioned between a position of a center of gravity of the movable body and the bearing in the gravity direction.

In an ordinary recording apparatus, the center of gravity of the movable body is higher than the bearing in the gravity direction. In such a recording apparatus in which the load center is higher than the center of gravity of the movable body, the directions of the force which the load center receives above the center of gravity and the force which the bearing receives below the center of gravity from the guide shaft are reversed. Accordingly, a turning force (a turning force with an intersecting direction, which intersects both the movement direction of the movable body and the gravity direction, as a rotation axis) acts on the movable body on a basis of the center of gravity. In other words, vibration occurs more easily in the front-back direction in relation to the movement direction of the movable body.

In addition, in a case in which the load center is provided below the bearing, the force which the load center receives and the force which the bearing receives from the guide shaft both act on the movable body below the center of gravity of the movable body in reverse directions to one another. However, the force which the load center receives is greater than the force which the bearing receives from the guide shaft, and the load center receives the force at a position farther from the center of gravity than the bearing. Accordingly, a turning force also acts on the movable body on a basis of the center of gravity even in this case, and vibration occurs more easily in the front-back direction in relation to the movement direction of the movable body.

In contrast, in this case, the load center receives the movement force between the center of gravity of the movable body and the bearing in the gravity direction. The force which the load center receives and the force which the bearing receives from the guide shaft both act on the movable body below the center of gravity of the movable body in reverse directions to one another. The force which the load center receives is greater than the force which the bearing receives from the guide shaft, and the load center receives force at a position closer to the center of gravity than the bearing. Accordingly, when the movable body moves, since the turning forces acting on a basis of the center of gravity offset one another and the movable body moves in a state in which the turning forces do not act thereon in the movement direction of the movable body, the vibration is reduced.

In addition, the bearing is supported by the guide shaft so as to be movable in the opposite direction from gravity in relation to the guide shaft. Accordingly, a situation in which the movable body may not be movable is reduced even in a case in which the precision of the linearity of the guide shaft is reduced a little.

In the recording apparatus, the load center is positioned on a straight line along a movement direction, where the straight line intersects a straight line in the gravity direction which passes through the center of gravity of the movable body, or the load center is positioned on a straight line along a movement direction, where the straight line intersects a straight line in the gravity direction which passes through a center portion of the support portion in a direction which intersects both the movement direction of the movable body and the gravity direction.

In this case, there are a turning force with the gravity direction as the axis of rotation and a turning force with the intersecting direction, which intersects both the movement direction of the movable body and the gravity direction, as the axis of rotation. Furthermore, when the movable body moves, since the movable body moves in a state in which neither of the turning forces act thereon, the vibration is further reduced.

The recording apparatus includes a plurality of guide shafts as the guide shaft, and in accordance with the plurality of guide shafts, the bearing includes a first bearing which is constrained in relation to one of the guide shafts in an intersecting direction which intersects both the movement direction of the movable body and the gravity direction, and a second bearing which is movable in relation to another of the guide shafts in the intersecting direction.

Here, the term "constrained" means a state in which there is substantially no gap in which the movable body can move in relation to the guide shaft in the relevant directions.

In this case, the bearing includes a first bearing which is constrained in relation to one of the guide shafts in an intersecting direction which intersects both the gravity direction and the movement direction of the movable body, and a second bearing which is movable in relation to another of the guide shafts in the intersecting direction. Accordingly, the degree of freedom of the installation position of the movable body in relation to the guide shaft is further increased, and a situation in which the movable body may not be movable is further reduced even in a case in which the precision of the linearity of the guide shaft is reduced a little.

In the recording apparatus, the load center is provided on a leading side of the movable body in a movement direction during recording.

In this case, during recording, in particular, the vibration in the horizontal direction of the movable body may be further reduced.

In the recording apparatus, the movable body is movable in a reverse direction from the movement direction during recording, and the load center is provided on a leading side of the movable body in the reverse direction.

In this case, even when the movable body moves in the reverse direction from that during recording, in particular, the vibration of the movable body in the horizontal direction may be further reduced. Furthermore, the recording may be performed when the movable body moves in the reverse direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Detailed description will be given below of recording apparatuses according to the embodiments of the invention with reference to the accompanying drawings.

In the embodiments below, description is given using an ink jet recording apparatus, which performs recording by discharging an ink from a recording head, as the recording apparatus. However, the recording apparatus of the invention is not limited to the ink jet recording apparatus. For example, the invention also includes a transfer method recording apparatus and the like.

In addition, in the embodiments below, a T-shirt, which is a fabric, is used as the recording medium P (refer to FIGS. 4A and 4B). However, the recording medium which is usable in the invention is not limited to a T-shirt, and is not limited to a fabric.

First Embodiment

FIGS. 1 to 5

First, description will be given of a recording apparatus according to an embodiment of the invention.

Figure 1:
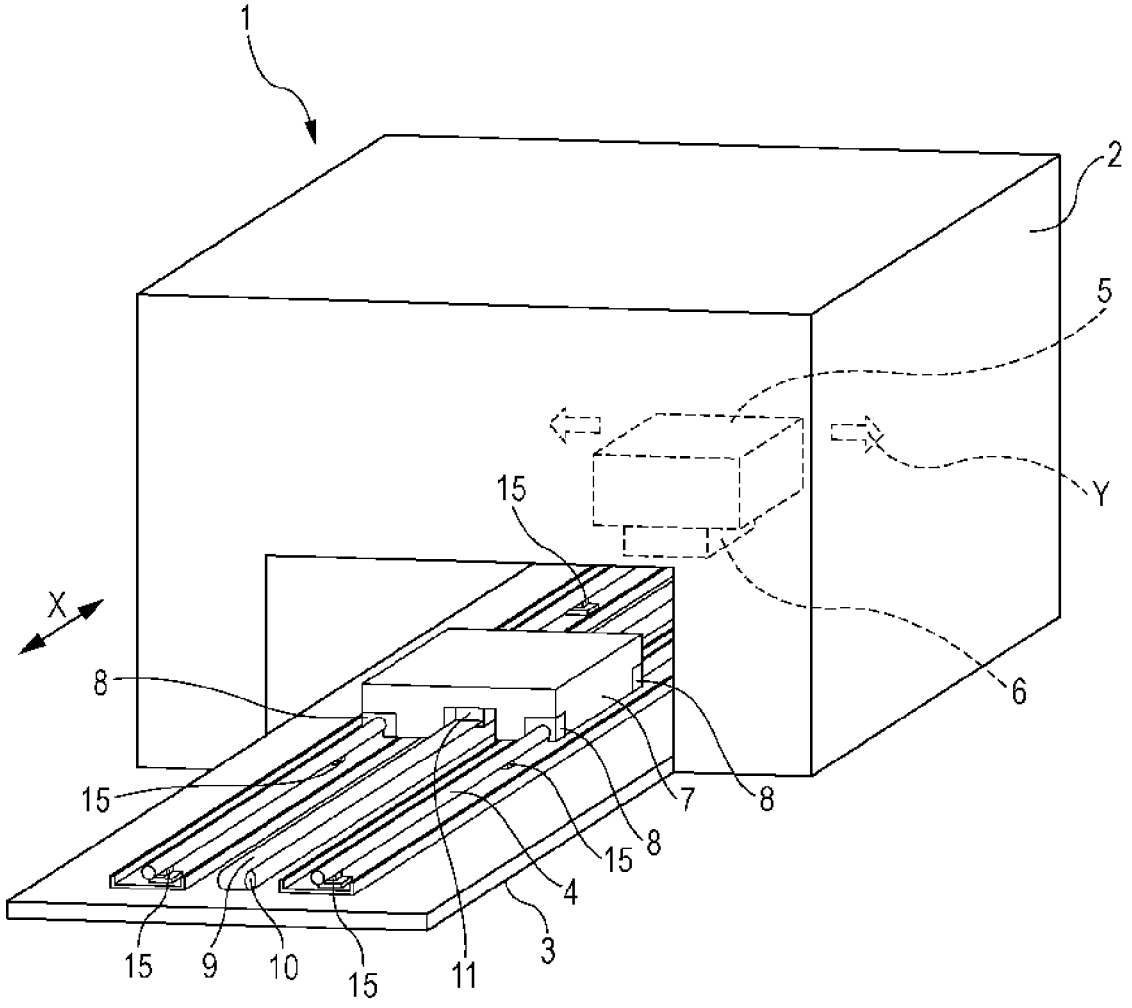
FIG. 1 is a schematic perspective view of a recording apparatus according to a first embodiment of the invention.

FIG. 1 is a schematic perspective view of the recording apparatus according to the first embodiment of the invention.

A recording apparatus 1 of the present embodiment includes a stage 7 which configures a movable body of the invention. Furthermore, the other components configuring the movable body of the invention are omitted in FIG. 1. The stage 7 moves along a pair of guide shafts 4 provided on a transportation unit 3 in a movement direction X on the guide shafts 4. Furthermore, the two guide shafts 4 are of the same configuration, and these guide shafts 4 are supported from beneath by a support member 15. In addition, the stage 7 includes, on the four corners thereof, bearings 8 which are supported by the guide shafts 4. A belt holder 11 is provided inside the stage 7 as the load center which receives a moving force from a belt 9. Pulleys 10 are provided on the front near side (the lower left side in FIG. 1) and the front interior side (the upper right side in FIG. 1) of the recording apparatus 1. The belt 9 is attached to the pulleys 10 of the front near side and the front interior side, and is rotated by the turning force of the motor (not shown) transmitted via the pulleys 10.

An apparatus main body 2 includes a recording head 6 as the recording unit. The recording apparatus 1 forms a desired image by discharging an ink from the recording head 6 onto the recording medium P while reciprocally moving the recording head 6 in a scanning direction Y which intersects a movement direction X via a carriage 5.

Figure 2:
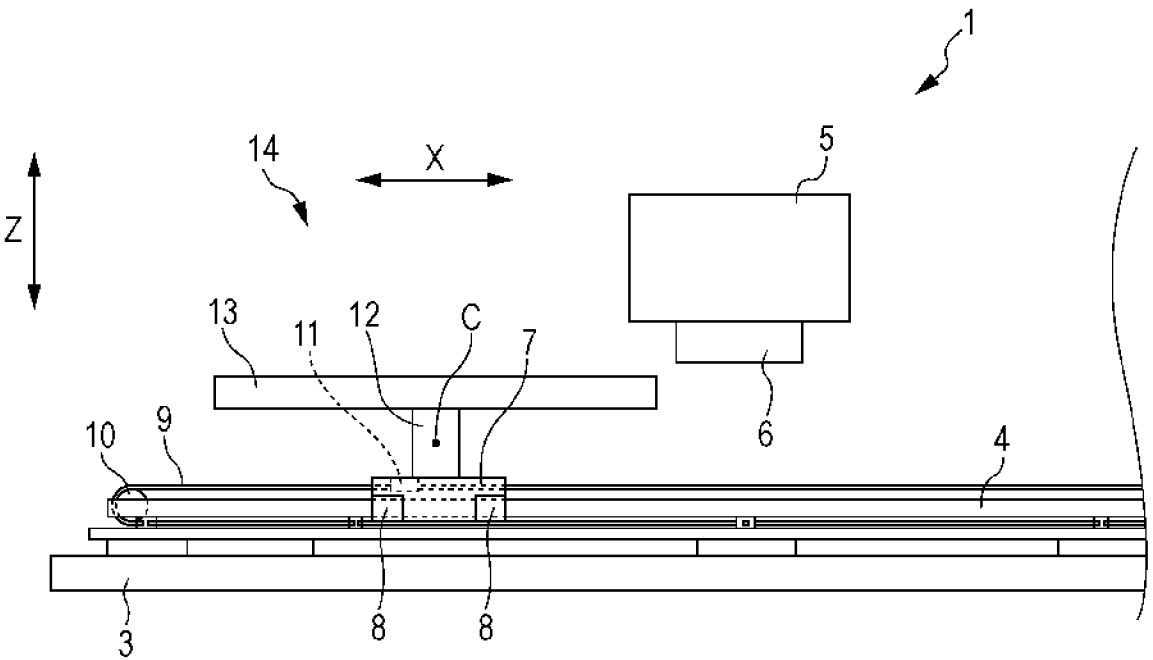
FIG. 2 is a schematic side view of the recording apparatus according to the first embodiment of the invention.

FIG. 2 is a schematic side view of the recording apparatus according to the first embodiment of the invention.

A movable body 14 is configured of the stage 7, a tray 13 which acts as the support portion which supports the recording medium P, and a column 12 which also serves as a height adjustment mechanism for adjusting the height of the tray 13. Furthermore, the tray 13 is removable in relation to the stage 7.

Figure 4A:
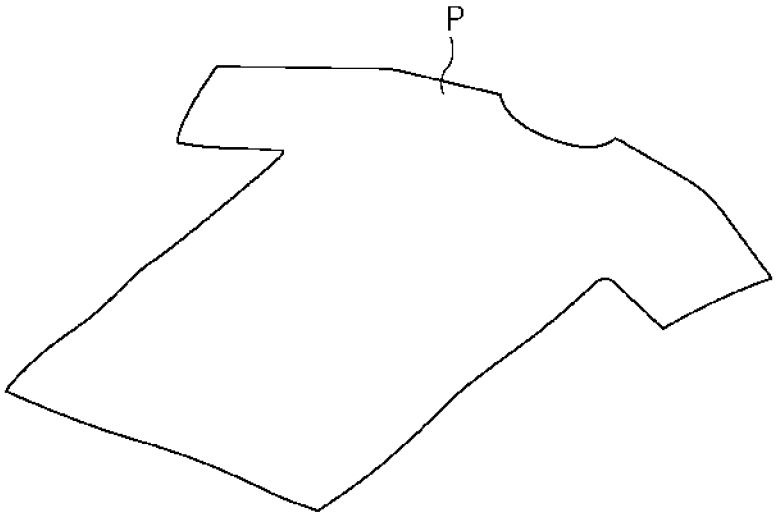
FIGS. 4A and 4B are perspective views of an example of a recording medium of the invention.
Figure 4B:
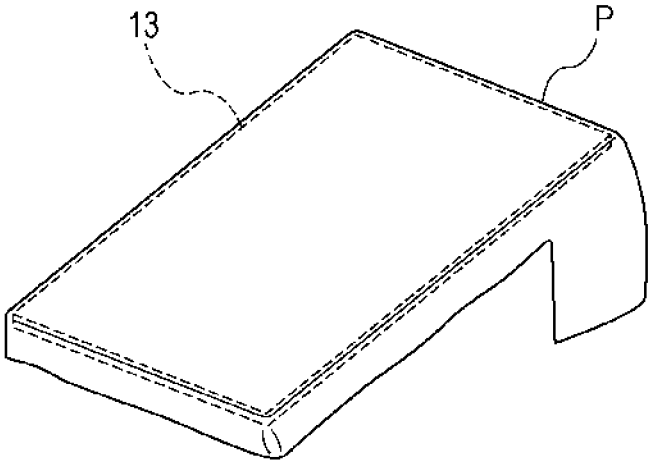

In the recording apparatus 1 of the present embodiment, the tray 13 is rectangular and is bilaterally symmetrical in the movement direction X of the movable body 14 (refer to FIG. 4B). In addition, the stage 7 and the column 12 are also substantially bilaterally symmetrical in the movement direction X. Accordingly, the position of the center of gravity C of the movable body 14 is a position of the center portion of the movable body 14 and the tray 13 in the width direction of the tray 13. In addition, the position of the center of gravity C of the movable body 14 is a position of the column 12 provided on the stage 7 in the gravity direction Z in relation to the guide shaft 4 of the movable body 14.

Next, description will be given of the position at which the belt holder 11 which serves as the load center is provided in the present embodiment.

Figure 3A:
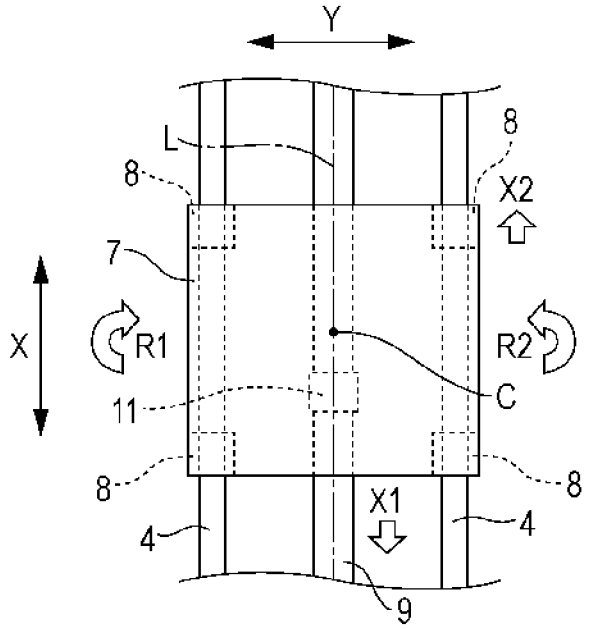
FIGS. 3A and 3B are schematic views of the main parts of the recording apparatus according to the first embodiment of the invention.
Figure 3B:
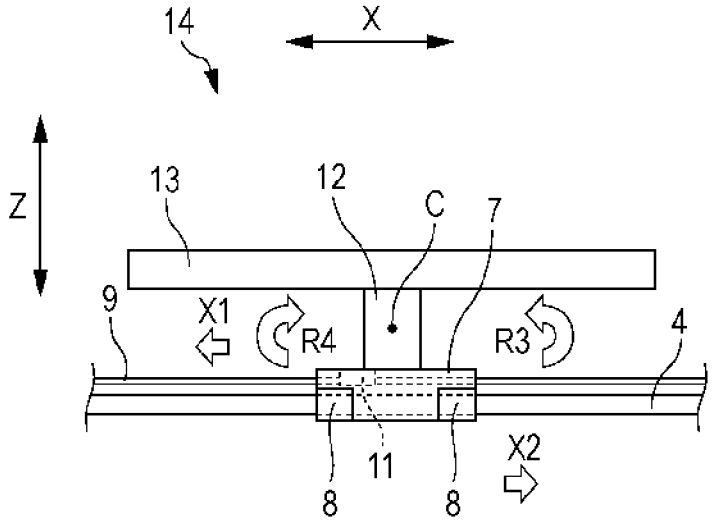

FIGS. 3A and 3B are schematic views of the main parts of the recording apparatus according to the first embodiment of the invention.

FIG. 3A is a plan view of the stage 7 which is a main part of the recording apparatus 1, and the tray 13 and the column 12 are omitted from the drawing.

In the present embodiment, the belt holder 11 intersects a straight line of the gravity direction Z which passes through the center of gravity C of the movable body 14, and receives a moving force on a straight line L along the movement direction X of the movable body 14. In other words, the belt holder 11 is provided on the straight line L in FIG. 3A. Furthermore, the movable body 14 in the present embodiment is substantially symmetrical in the direction Y which intersects both the movement direction X and the gravity direction Z. Accordingly, the straight line L is a straight line along the movement direction X, which intersects a straight line in the gravity direction which passes through a center portion of the tray 13 in a direction which intersects both the movement direction X and the gravity direction Z.

During recording, the stage 7 moves in a direction X1. Accordingly, during the recording, a force acts on the belt holder 11 in the direction X1. In addition, during the recording, a force acts on the bearings 8 in a direction X2. For example, in FIG. 3A, in a case in which the belt holder 11 is provided to be shifted to the right side of the straight line L, a turning force acts on the stage 7 in a direction R1. Conversely, in FIG. 3A, in a case in which the belt holder 11 is provided shifted to the left side of the straight line L, a turning force acts on the stage 7 in a direction R2.

Meanwhile, the belt holder 11 of the present embodiment is provided on the straight line L. Accordingly, when the stage 7 moves, since the stage 7 moves in a state in which turning force does not act thereon in the horizontal directions (the directions X and Y), the vibration is reduced.

Furthermore, the belt holder 11 is provided on the leading side of the movable body 14 in the movement direction X1 during the recording. Accordingly, during recording, in particular, the vibration in the horizontal directions of the movable body 14 may be further reduced in comparison to a recording apparatus that does not adopt this configuration.

FIG. 3B is a side view of the movable body 14 which is a main part of the recording apparatus 1.

In the present embodiment, the belt holder 11 receives the movement force between the center of gravity C of the movable body 14 and the bearing 8 in the gravity direction Z.

In a case in which the belt holder 11 is provided higher than the center of gravity C of the movable body 14, the direction X1 of the force which belt holder 11 receives above the center of gravity C and the direction X2 of the force which the bearing 8 receives below the center of gravity C from the guide shaft 4 are reversed. Accordingly, the turning force R3 acts on the movable body on the basis of the center of gravity C. In other words, vibration in the movement direction X of the movable body 14 occurs more easily.

In addition, in a case in which the belt holder 11 is provided lower than the bearing 8, the direction X1 of the force which belt holder 11 receives and the direction X2 of the force which the bearing 8 receives from the guide shaft 4 are reversed. Furthermore, the positions which receive these forces are received are both lower than the center of gravity of the movable body 14. However, the force which the belt holder 11 receives is greater than the force which the bearing 8 receives from the guide shaft 4, and the belt holder 11 receives the force at a position farther from the center of gravity C than the bearing 8. Accordingly, the turning force R4 acts on the movable body on the basis of the center of gravity C. In other words, vibration in the movement direction X of the movable body 14 occurs more easily.

Meanwhile, the belt holder 11 of the present embodiment receives the movement force between the center of gravity C of the movable body 14 and the bearing 8 in the gravity direction Z. The direction X1 of the force which the belt holder 11 receives and the direction X2 of the force which the bearing 8 receives from the guide shaft 4 are reversed, and the positions which receive these forces are both lower than the center of gravity of the movable body. In addition, the force which the belt holder 11 receives is greater than the force which the bearing 8 receives from the guide shaft 4. However, the belt holder 11 receives the force at a position closer to the center of gravity C than the bearing 8. Accordingly, when the movable body 14 moves, since the turning forces acting on a basis of the center of gravity C offset one another and the movable body 14 moves in a state in which turning force does not act thereon in the movement direction X of the movable body 14, the vibration is reduced.

FIG. 4A is a perspective view showing an example of the recording medium P of the invention and FIG. 4B is a perspective view of a state in which the recording medium P is set on the tray 13.

FIG. 4A is a T-shirt which serves as the recording medium P of the present embodiment. This recording medium P is set on an upper surface of the tray 13, as in FIG. 4B. After the recording medium P is set in this manner on the tray 13 in the position shown in FIG. 2, the recording apparatus 1 of the present embodiment starts recording.

Figure 5:
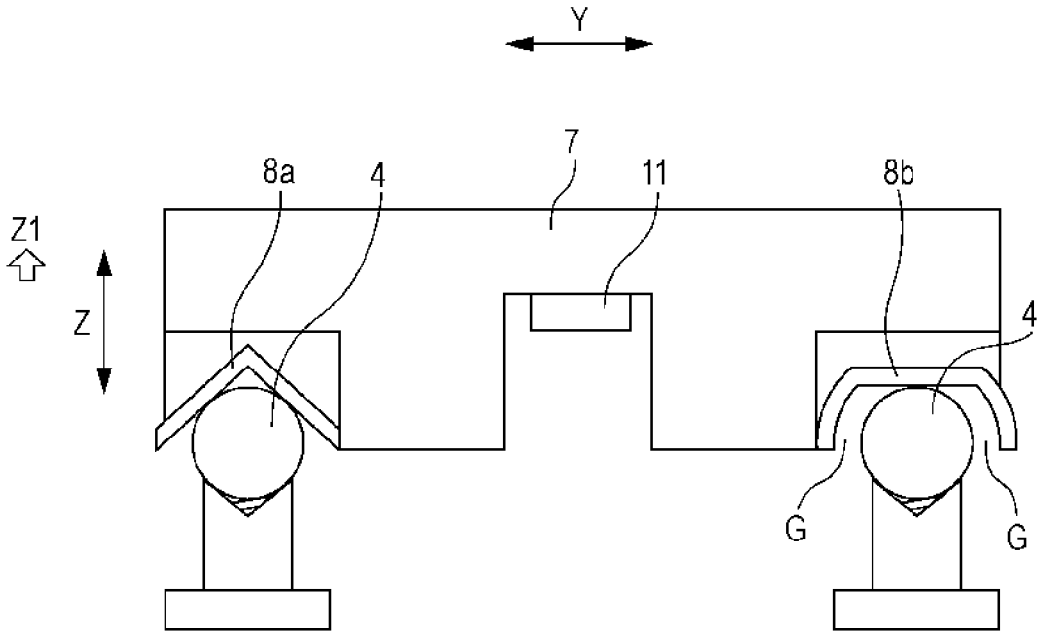
FIG. 5 is a front view of the main parts of the recording apparatus according to the first embodiment of the invention.

FIG. 5 is a front view of the stage 7, which is a main part of the recording apparatus of the first embodiment of the invention.

The recording apparatus 1 of the present embodiment is provided with two guide shafts 4 of the same configuration in parallel. Corresponding to the two guide shafts 4, the stage 7 includes a bearing 8*a* which serves as the first bearing and a bearing 8*b* which serves as the second bearing. The bearing 8*a* is of a gable shape formed by two inclined surfaces forming a mountain shape, and is supported so as to be constrained in the direction Y. However, the bearing 8*a* is supported so as to be movable in the gravity direction Z (the opposite direction from gravity Z1). In addition, the bearing 8*b* is of a half cylinder shape which has a horizontal surface portion on the upper portion thereof and has a missing portion of approximately half of the lower portion. Furthermore, the bearing 8*b* has a gap G in the horizontal direction in relation to the guide shaft 4. Accordingly, the bearing 8 is supported so as to be movable in the direction Y and the gravity direction Z (the direction opposite from gravity Z1).

Here, the term "the gravity direction Z (the opposite direction from gravity Z1)" is not limited to a strict definition of the gravity direction (the opposite direction from gravity), but means a direction which contains at least the vector component of the gravity direction (the opposite direction from gravity). In addition, the term "the gravity direction Z" can also be described as the direction which intersects a surface created by the movement direction X of the stage 7 and the scanning direction Y of the recording head 6. Furthermore, the term "the direction opposite from gravity Z1" refers to the direction (the direction from the support member 15 to the guide shaft 4) in which the support member 15 supports the guide shaft 4 along the gravity direction Z.

In the recording apparatus 1 of the present embodiment, the bearing 8*a* and the bearing 8*b* are both supported so as to be movable in the gravity direction Z, and the reason that the bearing 8*b* is configured to include a gap G in relation to the guide shaft 4 is given below.

In a case in which the bearing 8*a* and the bearing 8*b* are both supported so as to be constrained in all directions on the guide shaft 4, when the precision of the linearity of the guide shaft decreases, there is a case in which the frictional force which works on the contact surface between the bearings and the guide shaft increases and the stage 7 may no longer be moved. Accordingly, occurrences of a situation in which the movable body may not be movable are reduced even in a case in which the precision of the linearity of the guide shaft is reduced a little. Therefore, the recording apparatus of the invention is configured such that the bearing 8*a* and the bearing 8*b* are both supported so as to be movable in the gravity direction Z.

In addition, in the recording apparatus 1 of the present embodiment, the bearing 8*b* is configured to include the gap G in relation to the guide shaft 4 in the direction Y. By adopting such a configuration, it is possible to further reduce the occurrences of a situation in which the movable body may not be movable is reduced even in a case in which the precision of the linearity of the guide shaft is reduced a little. However, the invention is not limited to such a configuration.

Furthermore, the bearing 8*b* is supported so as to be movable in the direction Y, whereas the bearing 8*a* is supported so to be constrained in the direction Y. Accordingly, occurrences of a situation in which the movable body vibrates in the direction Y when the stage 7 moves and a situation in which the guide function deteriorates are suppressed.

Second Embodiment

FIG. 6

Next, description will be given of a recording apparatus of a second embodiment.

Figure 6:
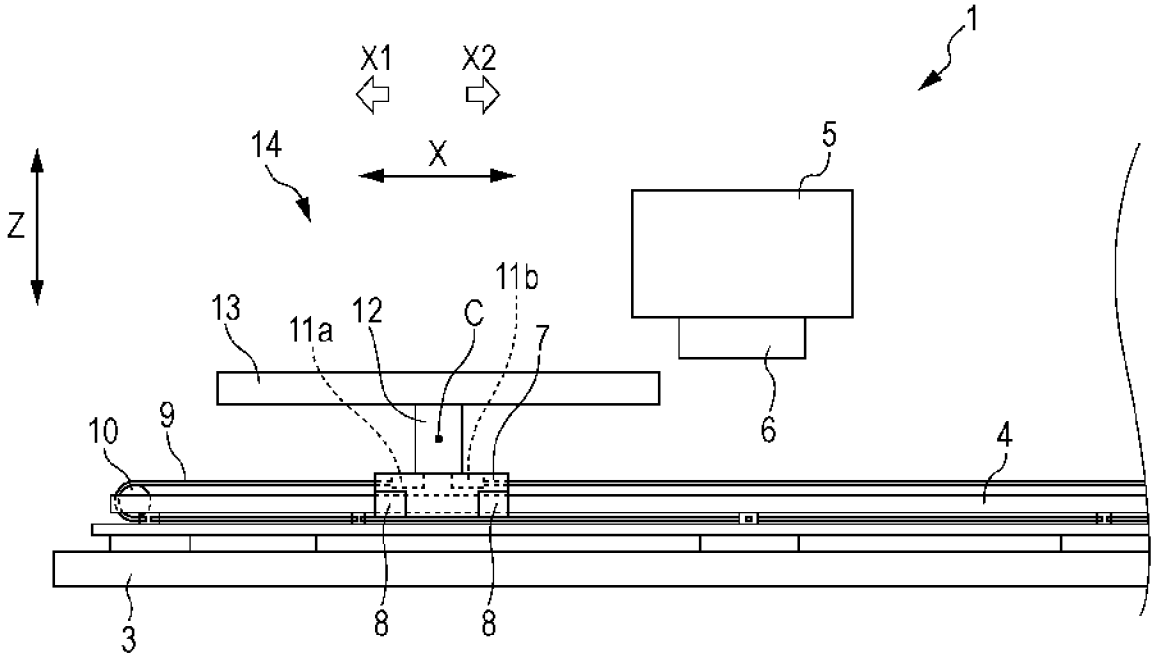
FIG. 6 is a schematic side view of the recording apparatus according to a second embodiment of the invention.

FIG. 6 is a schematic side view of the recording apparatus according to the second embodiment of the invention. Furthermore, components which are common with the first embodiment are represented with the same reference numerals, and detailed description thereof is omitted.

The belt holder 11 of the recording apparatus 1 of the first embodiment is provided only on the leading side of the movable body 14 in the movement direction X1 during the recording.

Meanwhile, the recording apparatus 1 of the present embodiment is provided with a belt holder 11*a* on the leading side of the movable body 14 in the movement direction X1 during recording. Furthermore, the recording apparatus 1 is provided with a belt holder 11*b* of the leading side on the movable body 14 in the reverse direction X2 during the recording. Accordingly, in the recording apparatus 1 of the present embodiment, when the movable body 14 moves in the movement direction X1 during recording or the like, the belt holder 11*a* receives moving force. In addition, when the movable body 14 moves in the reverse direction X2 from that during the recording, the belt holder 11*b* receives moving force.

Accordingly, whichever direction the movable body 14 moves in, the movable body 14 can receive the moving force at the leading side of the movement direction. Accordingly, not only during recording, but even when the movable body 14 moves in the reverse direction from that during recording, in particular, the vibration of the movable body 14 may be further reduced in the horizontal direction in comparison to a recording apparatus which does not adopt this configuration. Furthermore, the recording may be performed when the movable body moves in the reverse direction.

Other Examples

The recording apparatus 1 of the embodiments described above includes a pair of guide shafts (two guide shafts) which serve as the guide shaft. However, the recording apparatus of the invention may also include three or more guide shafts.

The entire disclosure of Japanese Patent Application No. 2012-181249, filed Aug. 18, 2012 is expressly incorporated by reference herein.

What is claimed is:

1. A recording apparatus comprising:

a recording unit which performs recording on a recording medium; and a movable body which includes a support portion that supports the recording medium and which moves along a guide shaft, wherein the movable body includes a bearing which is supported by the guide shaft and is movable in an opposite direction from gravity in relation to the guide shaft, and a load center which receives the moving force for the movement and is positioned on a straight line along a movement direction, where the straight line intersects a straight line in a gravity direction which passes through a center of gravity of the movable body.

2. The recording apparatus according to claim 1, wherein the recording apparatus includes a plurality of guide shafts as the guide shaft, and in accordance with the plurality of guide shafts, the bearing includes a first bearing which is constrained in relation to one of the guide shafts in an intersecting direction which intersects both the movement direction of the movable body and the gravity direction, and a second bearing which is movable in relation to another of the guide shafts in the intersecting direction.

3. The recording apparatus according to claim 1, wherein the load center is provided on a leading side of the movable body in a movement direction during recording.

4. The recording apparatus according to claim 3, wherein the movable body is movable in a reverse direction from the movement direction during recording, and the load center is provided on a leading side of the movable body in the reverse direction.

5. A recording apparatus comprising:

a recording unit which performs recording on a recording medium; and a movable body which includes a support portion that supports the recording medium and which moves along a guide shaft, wherein the movable body includes a bearing which is supported by the guide shaft and is movable in an opposite direction from gravity in relation to the guide shaft, and a load center which receives the moving force for the movement and is positioned on a straight line along a movement direction, where the straight line intersects a straight line in a gravity direction which passes through a center portion of the support portion in a direction which intersects both the movement direction of the movable body and the gravity direction.

6. A recording apparatus comprising:

a recording unit which performs recording on a recording medium; and a movable body which includes a support portion that supports the recording medium and which moves along a guide shaft, wherein the movable body includes a bearing which is supported by the guide shaft and is movable in an opposite direction from gravity in relation to the guide shaft, and a load center which receives the moving force for the movement and is positioned between a position of a center of gravity of the movable body and the bearing in the gravity direction.

7. The recording apparatus according to claim 6, wherein the load center is positioned on a straight line along a movement direction, where the straight line intersects a straight line in the gravity direction which passes through the center of gravity of the movable body, or is positioned on a straight line along a movement direction, where the straight line intersects a straight line in the gravity direction which passes through a center portion of the support portion in a direction which intersects both the movement direction of the movable body and the gravity direction.

* * * * *